US006973887B2

(12) United States Patent
Rattay

(10) Patent No.: US 6,973,887 B2
(45) Date of Patent: Dec. 13, 2005

(54) CHAIN STITCH SEWING MECHANISM

(75) Inventor: Frank Rattay, Altenburg (DE)

(73) Assignee: KSA GmbH & Co. KG, Altenburg (DE)

( * ) Notice: Subject to any disclaimer, the term of this patent is extended or adjusted under 35 U.S.C. 154(b) by 0 days.

(21) Appl. No.: 11/076,370

(22) Filed: Mar. 9, 2005

(65) Prior Publication Data

US 2005/0204976 A1 Sep. 22, 2005

(30) Foreign Application Priority Data

Mar. 16, 2004 (DE) ..... 10 2004 012 822

(51) Int. Cl.[7] ..... D05B 1/06; D05B 61/00
(52) U.S. Cl. ..... 112/197; 112/221; 112/470.12
(58) Field of Search ..... 112/197, 198, 162, 112/163, 165, 116, 98, 221, 187, 470.11, 112/470.12

(56) References Cited

U.S. PATENT DOCUMENTS 1,590,686 A * 6/1926 Holtermand ..... 112/475.17
1,714,928 A * 5/1929 Sigoda ..... 112/198
2,369,183 A * 2/1945 Sigoda ..... 112/98
2,533,292 A * 12/1950 Sigoda ..... 112/98
5,901,655 A * 5/1999 Sadasue ..... 112/162
6,357,371 B1 * 3/2002 Moll et al. ..... 112/475.17

FOREIGN PATENT DOCUMENTS

DE 197 51 011 A1 5/1999

* cited by examiner

*Primary Examiner*—Ismael Izaguirre
(74) *Attorney, Agent, or Firm*—McCormick, Paulding & Huber LLP

(57) ABSTRACT

In a chain stitch sewing mechanism with a sewing head movable parallel to the sewn material plane, including a needle rod with a needle drive for reciprocating a thread carrying needle, a catcher drive for reciprocating a needle shaped thread catcher with an open catching hook. The needle and thread catcher have movement paths forming a sharp angle with one another whose apex lies beneath the sewn material plane and the needle and catcher being so controlled such that a loop formed by the withdrawal of the needle is caught by the thread catcher and pulled through the material. A thread puller on a movable thread arm is moved towards the thread catcher and cooperates with the thread catcher for deflecting the loop hanging off the thread catcher at an angle to the movement path of the thread catcher toward the side opposite to that of the hook opening.

5 Claims, 2 Drawing Sheets

CHAIN STITCH SEWING MECHANISM

CROSS-REFERENCE TO RELATED APPLICATION

This application is entitled to the benefit of and incorporates by reference essential subject matter disclosed in German Patent Application No. 10 2004 012 822.7 filed on Mar. 16, 2004.

BACKGROUND OF THE INVENTION

The invention concerns a chain stitch sewing mechanism with a sewing head movable parallel to a sewn material plane, including a needle rod for a thread carrying needle, a needle drive for a moving the needle rod linearly back and forth at an angle to the sewn material plane, a needle shaped thread catcher provided with an open catching hook and a catcher drive for linearly moving the thread catcher back and forth at an angle to the sewn material plane, with the movement paths of the needle and of the thread catcher forming a sharp angle with one another whose apex lies below the sewn material plane, and with the needle drive and the catcher drive being so controlled that upon a withdrawal of the needle from the sewn material a thread loop is formed below the sewn material which is caught by the thread catcher and pulled upwardly through the sewn material.

Such a sewing mechanism is, for example, known from DE 197 51 011 A1. In the solution described there, the thread catcher during its up and down movement is also driven oscillatingly in rotation about its linear movement direction. Upon the insertion of the thread catcher into the sewn material, the thread catcher takes on a rotary position at which the hook opening is oriented at least nearly in the advancement direction of the sewing head, so that the thread loop upon the moving forwardly of the sewing head does not slip from the catcher and the new loop can be drawn through the preceding loop to make possible a true chaining of the loops. However, before the upward movement of the thread catcher with the newly caught loop the thread catcher is pivoted to a rotary position at which the hook opening faces nearly oppositely to the transport direction of the sewing head to avoid the loop lying on the upper surface of the sewn material being caught again by the hook during the upward movement of the thread catcher. In order to move the thread catcher both linearly up and down and also to rotate it back and forth about its linear movement path, a complicated mechanism necessary.

SUMMARY OF THE INVENTION

The invention has as its object the provision of a sewing mechanism of the previously mentioned kind, which is not only functionally reliable but is also easy to construct.

This object is solved in accordance with the invention in that the thread catcher has associated with it a driven thread puller having an arm movable at an angle to the movement path of the thread catcher into the path of the thread loop hanging onto the thread catcher, and whose drive is so controlled that the arm close to the uppermost position of the thread catcher deflects the thread loop hanging on the thread catcher at an angle to the movement path of the thread catcher toward the side opposite to that of the hook opening.

In the case of the sewing mechanism according to the invention, the thread catcher moves only up and down and moreover retains a position at which the hook opening faces oppositely to the sewing direction. Accordingly, the danger of the thread catcher catching the already laid down thread loop on the upper surface of the sewn material upon the drawing up of the new thread loop is avoided. On the other hand, by way of the thread puller, the new thread loop hanging in the thread catcher and the upper position of the thread catcher is tensioned, so that it can not slide from the thread catcher when the thread catcher reverses its movement direction in order to again insert itself into the sewn material. In this way, it is assured that the thread catcher during its downward movement will be inserted through the loop and into the sewn material and that the new loop upon the return movement of the thread catcher will be pulled through the loop laid onto the upper side of the sewn material. The mechanism of the invention is simply to realize and assures a true chain formation.

The arm of the thread puller can, for example, be made from a wire shaped bow which extends essentially parallel to the sewn material plane and which is so supported that its free end when it is actuated by its drive—in a projection perpendicularly onto the sewn material plane—moves along an annular dosed path. Throughout this movement path, it is avoided that the thread catcher and the thread puller interfere with one another.

To assure a true stitch formation, the movement path of the thread catcher is oriented essentially perpendicularly to the sewn material plane with the movement paths of the needle and of the thread catcher lying in a plane at an angle to the advancement direction of the sewing head and perpendicular to the sewn material plane. The angle between the movement paths of the thread catcher and of the needle lies preferably in the range of from 30° to 60°.

Since the sewing head in total has a relatively large mass, it is advantageous if it can be moved continuously to avoid a constant braking and acceleration of the sewing head. To make such a continuous movement possible, at least the needle and the thread catcher, and as the case may be perhaps also the thread puller, are advantageously arranged, together with their individual drives, on a frame in the sewing head housing which frame is movable back and forth parallel to the sewing direction, so that the sewing head as a whole can be moved in the sewing direction when the needle and/or the thread catcher are still located in the sewn material. As soon as the thread catcher and the needle have both been withdrawn from the sewn material, the frame follows up the sewing head movement inside of the sewing head housing, until the needle again moves into the sewn material.

BRIEF DESCRIPTION OF THE DRAWINGS

Further features and advantages of the invention will be apparent from the following description which in combination with the accompanying drawings explains the invention by way of an exemplary embodiment. The drawings are.

DETAILED DESCRIPTION OF THE PREFERRED EMBODIMENTS

Figure 1:
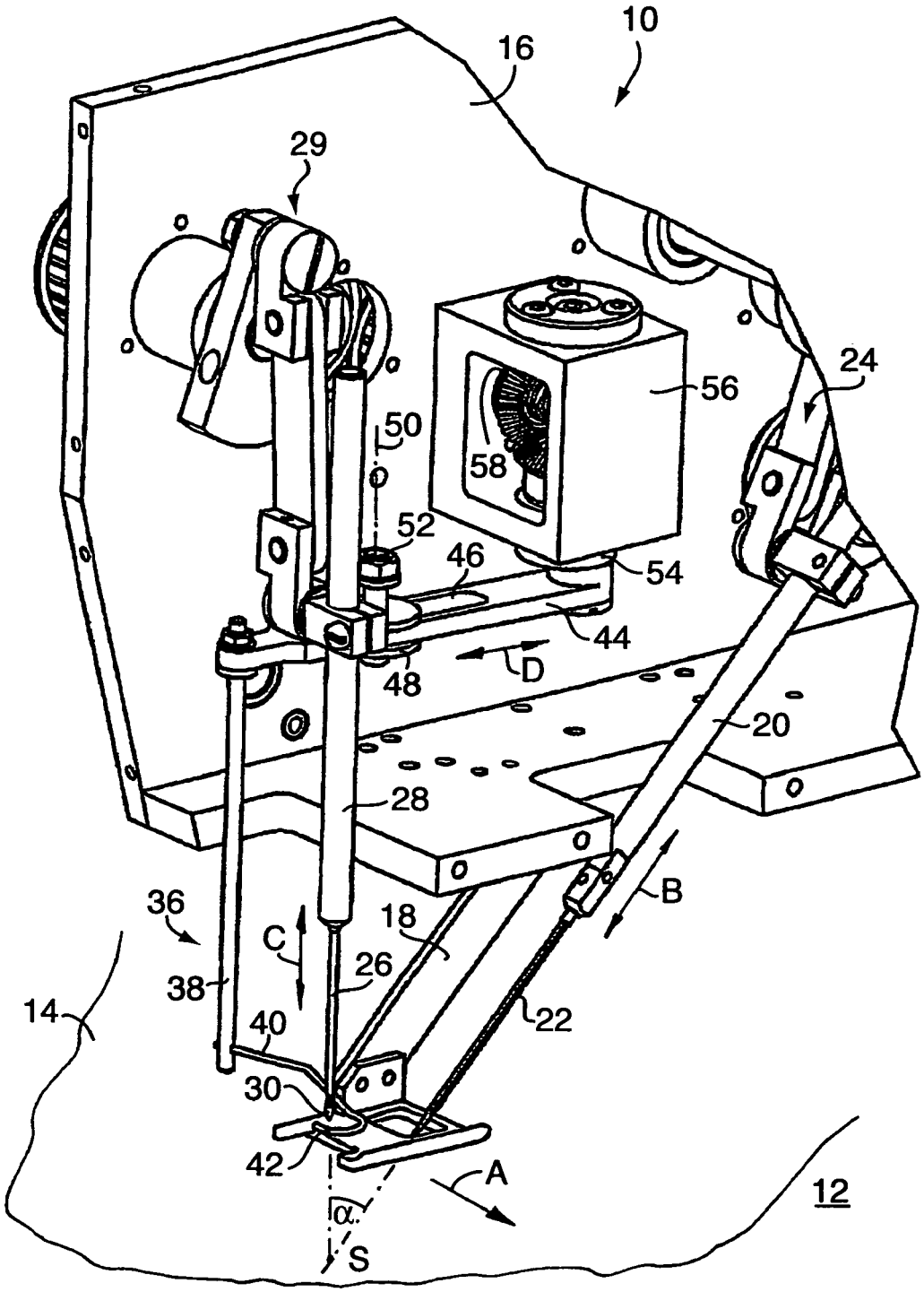
FIG. 1 a schematic perspective partial view of a sewing mechanism embodying the invention, FIG. 2 schematic illustration of the thread catcher and of the associated thread puller for explaining the functioning of the thread puller, FIG. 3 schematic illustration of the thread catcher and of the associated thread puller for explaining the functioning of the thread puller, and FIG. 4 schematic illustration of the thread catcher and of the associated thread puller for explaining the functioning of the thread puller.

In FIG. 1 a sewing head is schematically illustrated at 10, which sewing head in a way known in itself can hang from a non-illustrated robot arm and with the help of the robot can be moved in the direction of the arrow A parallel to a sewn material support surface 12 over a sewn material 14 lying on the support surface. A sewn material hold-down 18 is arranged on the housing 16 of the sewing head 10. Further shown is a needle rod 20 which carries a needle 22 and which is movable back and forth in the direction in the arrow B by an incompletely illustrated drive 24. The needle 22 is designed to stick through the sewn material 14 and with this action to pull a thread through the sewn material 14.

Further, a needle shaped thread catcher 26 is arranged on the sewing head, which thread catcher is held by a catcher rod 28 and is movable up and down in the direction of the arrow C essentially perpendicularly to the sewn material support surface 12 by a catcher drive 29 inside of the sewing head housing 16.

As is to be seen in FIG. 1, the movement directions B and C of the needle 22 and of the thread catcher 26 form an angle $\alpha$ with one another, which angle preferably has a value of between 30° and 60° and whose apex S lies below the underside of the sewn material 14. When the needle 22 is inserted through the sewn material 14 upon its being drawn back it forms a thread loop. Subsequently, the needle shaped thread catcher 26 sticks through this thread loop and upon its upward movement catches the thread loop by means of a hook 30 formed on its lower end. With its upward movement, it pulls this loop 32 through the sewn material 14 and upwardly out of the sewn material 14 and through the immediately previously formed loop 32' laid onto the upper surface of the sewn material 14 as is to be seen in FIGS. 2 to 4. The thread catcher 26 is so oriented that the opening 34 of the hook 30 faces oppositely to the advancement direction A of the sewing head 10. As soon as the thread catcher 26 is pulled out of the sewn material 14, the sewing head 10 or the seam forming instruments 22 and 26 shift forwardly in the direction of the arrow A before a new cycle begins with the sticking of the needle 22 into the sewn material 14.

The needle rod 20 and the catcher rod 28 are guided in a frame, which for purposes of better clearness of the illustration is not shown in FIG. 1 and which in a way known in itself is so arranged inside of the housing 16 it is movable back and forth in the sewing direction A relative to the housing 16. Thereby, the housing 16 of the sewing head 10 can be continuously moved while the needle 22 and the thread catcher 26 are then only forwardly advanced when they are located outside the sewing material 14.

As one will understand from the preceding description of the stitch formation, there exists with it the danger that upon the advancement of the sewing head 10 or of the stitch forming instruments, the loop 32 can move out of the hook or can be so tensioned that the thread catcher 26 upon its insertion into the sewn material 14 no longer moves through the loop 32. This, however, is necessary in order to achieve a chaining of the loops.

To assure that the thread catcher 26 upon its insertion into the sewn material 14 also passes through the loop 32, a thread puller, indicated generally at the 36, is provided. This puller includes an essentially vertical rod 38 to the lower end of which is fastened an arm 40, which arm is oriented essentially parallel to the sewing material support surface 12 and has a bent U-shaped hooked end 42. The rod 38 is fastened to the one end of a horizontal lever 44 which by means of a longitudinal hole 46 is slidable on a slide block 48 in the direction of the arrow D and is pivotal about the axis 50 of a bolt 52. The slide block 38 is fastened by the bolt 52 to a non-illustrated carrier fixed to the housing. The other end of the lever 44 is connected to an eccentric 54 which is supported by a support piece 56 fixed to the housing, and which eccentric is driven by bevel gears 58.

Through the drive of the lever 44 by way of the eccentric 54 the hook shaped end 42 of the arm 50 executes a movement along an annular closed nearly elliptical curve path. The effect of the thread puller 36 will now be explained in more detail by way of FIGS. 2 to 4.

Figure 2:
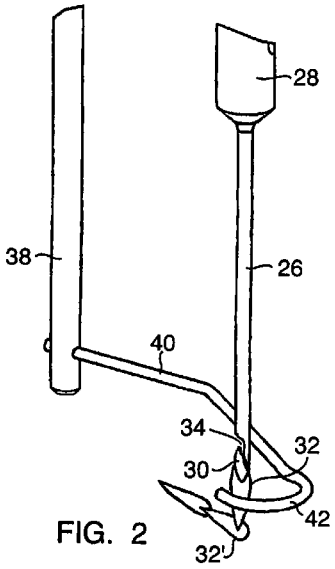
Figure 3:
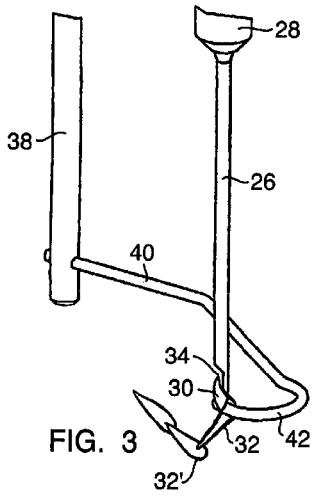
Figure 4:
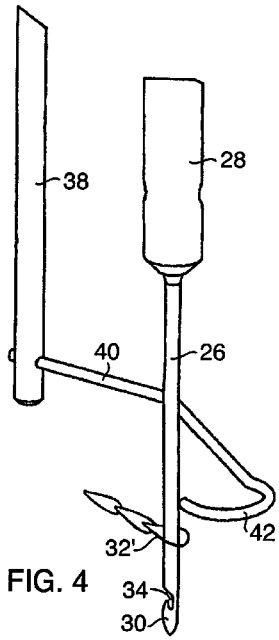

FIG. 2 shows a position of the thread catcher 26 and of the arm 38 of the thread puller corresponding to that of FIG. 1, that is shortly before or when the thread catcher 26 has reached its upper dead point and the loop 32 had been pulled from the sewn material 14. Now, before the thread catcher 26 is again moved in the direction toward the sewn material 14, the arm 40 is pivoted in the direction toward the loop 32 so that the loop is deflected nearly in the advancement direction of the sewing head 10 and so that the loop 32 is pulled into the hook 30 as is to be seen in FIG. 3. It will be understood with a downward movement of the thread catcher 26 from the position illustrated in FIG. 3, the thread catcher 26 will now move through the loop 32 so that the loop rides upwardly on the thread catcher 26 and out of the hook 30. Shortly before the thread catcher moves into the sewn material 14 the arm 40 of the thread puller 36 is withdrawn (FIG. 4). In this way it is made certain that the thread catcher 26 upon its sticking into the sewn material 14 will pass through the loop 32, and also that upon its upward movement it will pull the new loop through the loop 32' then lying on the upper surface of the sewn material, so as to form a chain stitch. The thread puller 36 is realized by simple means and assures a reliable functioning of the sewing mechanism.

What is claimed is:

1. A chain stitch sewing mechanism with a sewing head movable parallel to a sewn material plane, which sewing head includes a needle rod for a thread carrying needle, a needle drive for linearly moving the needle rod back and forth at an angle to the sewn material plane, a needle shaped thread catcher provided with an open catching hook and a catcher drive for linearly moving the thread catcher back and forth at an angle to the sewn material plane, with the movement path of the needle and of the thread catcher forming a sharp angle $\alpha$ with one another whose apex S lies below the sewn material plane and with the needle drive and the catcher drive being so controlled that a thread loop formed by the withdrawal of the needle out of the sewn material and located below the sewn material is caught by the thread catcher and pulled by the thread catcher upwardly through the sewn material, wherein a driven thread puller is associated with the thread catcher, which thread puller has an arm movable at an angle to the movement path of the thread catcher into the path of the thread loop hanging on the thread catcher and whose drive is so controlled that the arm near the uppermost position of the thread catcher deflects the thread loop hanging from the thread catcher at an angle to the movement path of the thread catcher and toward the side opposite to that of the hook opening.

2. A chain stitch sewing mechanism according to claim 1, wherein the arm of the thread puller is made from a wire shaped bow, which bow extends essentially parallel to the sewn material plane and is so supported that its free end upon actuation of its drive moves along—as seen in a perpendicular projection onto the sewn material plane—an annular closed path.

3. A chain stitch sewing mechanism according to claim 1, wherein the movement path of the thread catcher is oriented essentially perpendicularly to the sewn material plane and that the movement path of the needle and of the thread catcher lie in a plane at an angle to the advancement direction A of the sewing head and perpendicular to the sewn material plane.

4. A chain stitch sewing mechanism according to claim 1, wherein the angle $\alpha$ between the movement paths of the thread catcher and of the needle has a value of about 30° to 60°.

5. A chain stitch sewing mechanism according to claim 1, wherein at least the needle and the thread catcher together with their individual drives are arranged on a frame located in the sewing head housing and movable back and forth parallel to the advancement direction A of the sewing head.

* * * * *